US006955132B2

(12) United States Patent
Dallas et al.

(10) Patent No.: US 6,955,132 B2
(45) Date of Patent: Oct. 18, 2005

(54) METHOD AND APPARATUS FOR SPLICING INDETERMINATE LENGTH FIBER TOW ENDS

(75) Inventors: Michael J. Dallas, Alachua, FL (US); Edd McGaric Tan Ong, Gainesville, FL (US); Francisco Abufele, Miami, FL (US); Ian M. Watson, Winter Park, FL (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 10/840,638

(22) Filed: May 7, 2004

(65) Prior Publication Data

US 2005/0005830 A1 Jan. 13, 2005

Related U.S. Application Data

(60) Provisional application No. 60/468,639, filed on May 8, 2003.

(51) Int. Cl.[7] ..... D05B 21/00

(52) U.S. Cl. ..... 112/470.06; 19/144

(58) Field of Search ..... 112/7, 8, 102.5, 112/470.6, 470.7, 470.12, 470.23; 19/0.3, 0.58, 0.6, 144, 145.7, 150

(56) References Cited

U.S. PATENT DOCUMENTS

| | | | | |
|---|---|---|---|---|
| 3,308,520 A | * | 3/1967 | Gagnon | 19/0.46 |
| 4,815,405 A | * | 3/1989 | Young, Jr. | 112/470.12 |
| 5,679,300 A | | 10/1997 | Lorenz et al. | |
| 5,804,303 A | | 9/1998 | Lorenz et al. | |
| 5,878,464 A | | 3/1999 | White | |
| 5,913,797 A | | 6/1999 | Saleh | |
| 6,029,552 A | | 2/2000 | Harris | |
| 6,385,828 B1 | | 5/2002 | Kiss et al. | |

* cited by examiner

*Primary Examiner*—John J. Calvert
*Assistant Examiner*—Brian Kauffman
(74) *Attorney, Agent, or Firm*—Banner & Witcoff, Ltd.; John P. Foryt

(57) ABSTRACT

Indeterminate length fiber tows ends are joined by overlapping end portions of the first and second fiber tows. The first and second tows are secured in a clamp with a portion of the overlapping area exposed. The overlapping area of the tows is positioned on a sewing unit having a support and sewing head, at least one of which is displaceable along first and second axes, and a controller for executing a preprogrammed stitching pattern. The controller is actuated to form the preprogrammed stitching pattern in the exposed portion of the overlapping area, thereby splicing the first and second fiber tows.

17 Claims, 12 Drawing Sheets

METHOD AND APPARATUS FOR SPLICING INDETERMINATE LENGTH FIBER TOW ENDS

CROSS REFERENCE TO RELATED APPLICATION

This application claims benefit under 35 U.S.C. § 119(e) to provisional Application No. 60/468,639, filed May 8, 2003, the disclosure of which is hereby incorporated by reference in its entirety.

FIELD OF THE INVENTION

The present invention is directed to fiber tow processing and, more particularly to methods and devices for splicing ends of indeterminate length fiber tow prior to stretching, heat-setting, and cutting the tow into staple lengths.

BACKGROUND OF THE INVENTION

In the conventional manufacture of synthetic textile yarns, a molten polymeric material is extruded in the form of multiple continuous filaments which, after quenching to cool the filaments below their glass transition temperature, are gathered and transported longitudinally in an indeterminate length coextensive bundle commonly referred to as a tow. A driven take-up unit disposed downstream of the extruding apparatus delivers the tow at a controlled transport speed to a canning station at which the tow is deposited into an open-top can or similar container for storage and, in some cases, transportation to another site for further processing.

In a typical drawing operation, tows from a plurality of the filled cans are placed in a common creel for delivery and processing in side-by-side parallel warp sheet form through a draw frame to subject the tows simultaneously to a stretching and heat setting operation to orient the molecular structure of each constituent filament in each tow. Following the stretching and heat setting steps, the tow usually is chopped into staple lengths from which yarn can be spun. Prior to spinning, the staple length tows often are subjected to a carding process to restore uniformity to the material that may be lost during chopping.

In a typical operation, the indeterminate length tow is continuously fed from the container to the stretching and heat setting equipment until the container is emptied. The process is then interrupted, while the leading end of a tow from a new container is joined to the trailing end of the tow from the emptied container by manually sewing the tow ends together. This manual splicing process is sometimes referred to as lacing. FIG. 1B illustrates a tow splice form by lacing.

Once the ends of the new tow and expiring tow are joined, stretching and heat setting processes are resumed. In one typical stretching process, the tow is engaged by a first roller rotating at one rate (e.g., 100 rpm), followed by a closely-spaced second roller rotating at a relatively higher rate (e.g., 300 rpm). Such rollers subject the tow splice to forces on the order of 1,200 $lb_f$. The splice needs to be of sufficient strength to keep the tow ends together during the stretching and heat setting processes. Otherwise, the equipment needs to be shut down to resolve the splice failure, resulting in additional downtime.

The present lacing technique for joining indeterminate length tow ends suffers from several drawbacks. For one, the process is labor-intensive and time-consuming, requiring significant downtime. Another drawback is that a relatively large area of overlap is needed to form a splice having sufficient strength to withstand the ensuing stretching and heat setting operations. This large area of overlap leads to a higher occurrence of inferior quality (or unusable) fiber due to the fibers in the area of the splice not being sufficiently stretched and heat-set. Yet another problem with lacing is the occurrence of so-called wraps, which refer to small portions of the unwoven tow becoming entangled in the rollers of the stretching machine. When this occurs, it is necessary to interrupt operation to clear the entangled tow, producing yet more costly downtime. Lacing also can have result in hard (more dense) areas in the stretched and heat-set staple tow product. The equipment used in many types of downstream textile operations can be sensitive to these hard areas, resulting in production irregularities and/or damage to the equipment.

It would be desirable to develop an alternative technique for joining fiber tow ends, especially one that can be completed in less time than is required for present lacing techniques. It would be desirable to produce splices of consistently high quality, so as to reduce the occurrence of splice failure and associated interruption of the stretching and heat setting or other downstream operations. It also would be desirable to reduce the amount of inferior quality fiber produced due to the large area of overlap needed for the splice in present lacing techniques.

SUMMARY OF THE INVENTION

According to one aspect of the present invention, a method of joining indeterminate length fiber tows end-to-end is provided. The method comprises providing a first fiber tow and a second fiber tow. A portion of the first tow is placed over the second tow such that the first and second tows overlap each other in the area of their respective ends. The first and second tows are secured, with at least a portion of the overlapping area exposed. The overlapping area of the tows is positioned on a sewing unit having a sewing head displaceable along first and second axes, and a controller for executing a preprogrammed stitching pattern. The sewing unit is actuated to displace the sewing head along the first and second axes so as to form the preprogranmed stitching pattern in the exposed portion of the overlapping area, thereby splicing the first and second tows.

According to another aspect of the present invention, an apparatus for joining indeterminate length fiber tow ends is provided. The apparatus comprises a substrate supporting surface, a sewing unit having a sewing head displaceable along first and second axes, and means for displacing the sewing head along the first and second axes. The overlapping first and second tow end portions are secured, with at least a portion of the overlapping area exposed in the proximity of the sewing head. A controller actuates the sewing head to apply a preprogrammed stitching pattern in the exposed portion of the overlapping area, thereby splicing the first and second tows.

In accordance with an alternative embodiment of the invention, a method and apparatus for joining indeterminate length fiber tow ends is provided. The apparatus comprises a plate assembly displaceable along first and second axes, a sewing unit having a sewing head positioned adjacent to the plate assembly, and means for displacing the plate assembly along the first and second axes. A portion of a first tow is placed over a second tow such that the first and second tows overlap each other in the area of their respective ends. The overlapping first and second tow end portions are secured in the plate assembly, while at least a portion of the overlapping area is exposed. The plate assembly is controllably displaced along the first and second axes as the sewing head is operated so that a preprogrammed stitching pattern is applied in the exposed portion of the overlapping area, thereby splicing the first and second tows.

According to another aspect of the invention, a fiber tow splice comprises a first fiber tow and a second fiber tow, wherein each tow has a width and wherein an end portion of the first tow overlaps an end portion of the second tow to form an overlapping area. A thread is sewn through the overlapping area in a predetermined stitching pattern. The stitching pattern comprises a plurality of generally parallel lines in the width dimension of the tows, and at least one diagonal line traversing at least some of the generally parallel lines.

The present invention provides an efficient and cost-effective alternative to the current techniques of manually sewing indeterminate-length tow ends together. The present invention overcomes many of the drawbacks of current lacing techniques, especially the extended periods of downtime needed for manual sewing as well as the high occurrence of inferior-quality fiber resulting from the large area of overlap needed for lacing. The present invention also reduces the frequency of downtime associate with the occurrence of wraps in the stretching equipment, and reduces the occurrence of hard areas in the fiber that can be deleterious to downstream textile processing.

BRIEF DESCRIPTION OF THE DRAWINGS

The objects, features, and advantages of the invention will be apparent from the following more detailed description of certain embodiments of the invention and as illustrated in the accompanying drawings in which:

FIG. 8A is a perspective view; FIG. 8B is a top view; FIG. 8C is a side view; FIG. 8D is an end view;

FIG. 9A is a top view; FIG. 9B is a perspective view; FIG. 9C is a side view; FIG. 9D is an end view.

DETAILED DESCRIPTION OF THE INVENTION

For convenience, the present invention will be described below with reference to processing synthetic fiber tow, such as polyester, nylon-6, nylon-6,6, polypropylene, acrylic fibers, or blends thereof. It should be understood that the present invention is not limited to processing synthetic fibers, or any particular type of fibers. The methods and devices of the present invention can be used for joining any type of loose fibers, including both natural and synthetic fibers.

The thread used for splicing the tow ends can be selected in accordance with such factors as strength and compatibility with the type of fiber present in the tow being spliced. Generally, it is preferred to use the same type of fiber for the thread as is present in the tow being spliced, although the invention is not limited to any particular type of thread or material for forming the splice.

Figure 2:
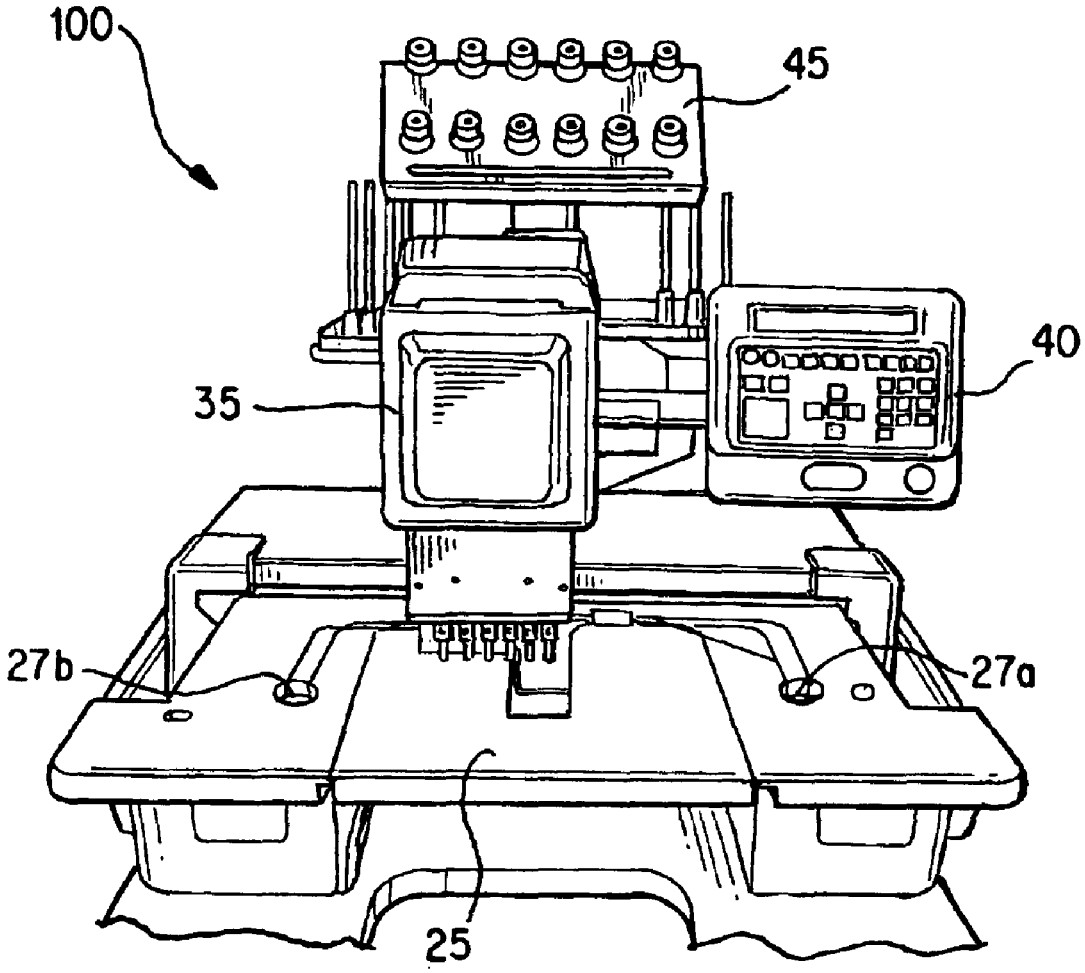
FIG. 2 is a front view of an embroidery machine for splicing fiber tows end-to-end in accordance with a preferred embodiment of the invention.

With reference to FIG. 2, a commercially available embroidery machine 100 can be modified to splice fiber tow ends in accordance with the present invention. An example of a suitable embroidery machine 100 is a Toyota ESP Model 820. The machine 100 includes a supply 45 of thread, a controller 40, and a sewing head 35 that is displaceable by actuation of an electric motor along the x and y coordinate axes relative to a stationary substrate support surface 25. The controller 40 contains a microprocessor for actuating the sewing head to apply a preprogrammed stitching pattern. The machine 100 also includes threaded apertures 27*a*, 27*b* for receiving screws to secure a clamp to the substrate supporting surface 25, as described more fully below.

The sewing or embroidery device used for forming the splice can be provided, for example, on a cart equipped with caster wheels to enable the device to be easily transported from one location to another. Alternatively, a sewing or embroidery device can be supported by an overhead pulley and track system to enable the device to be stored overhead when not in use, as well as transported from one location within a facility to another as needed.

Figure 3:
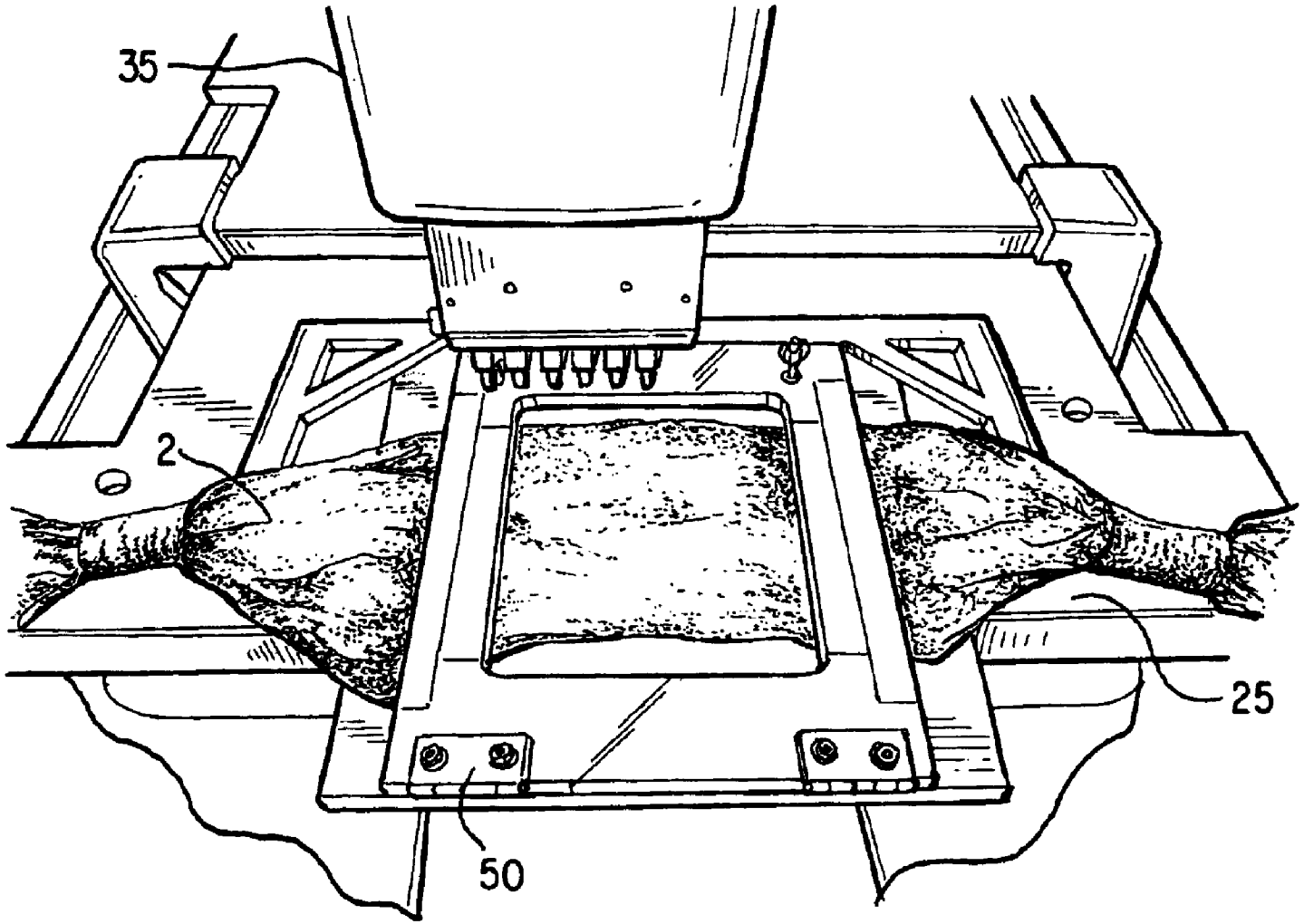
FIG. 3 is a front view of the embroidery machine of FIG. 2 having first and second tows secured by a clamp in preparation for splicing.
Figure 4:
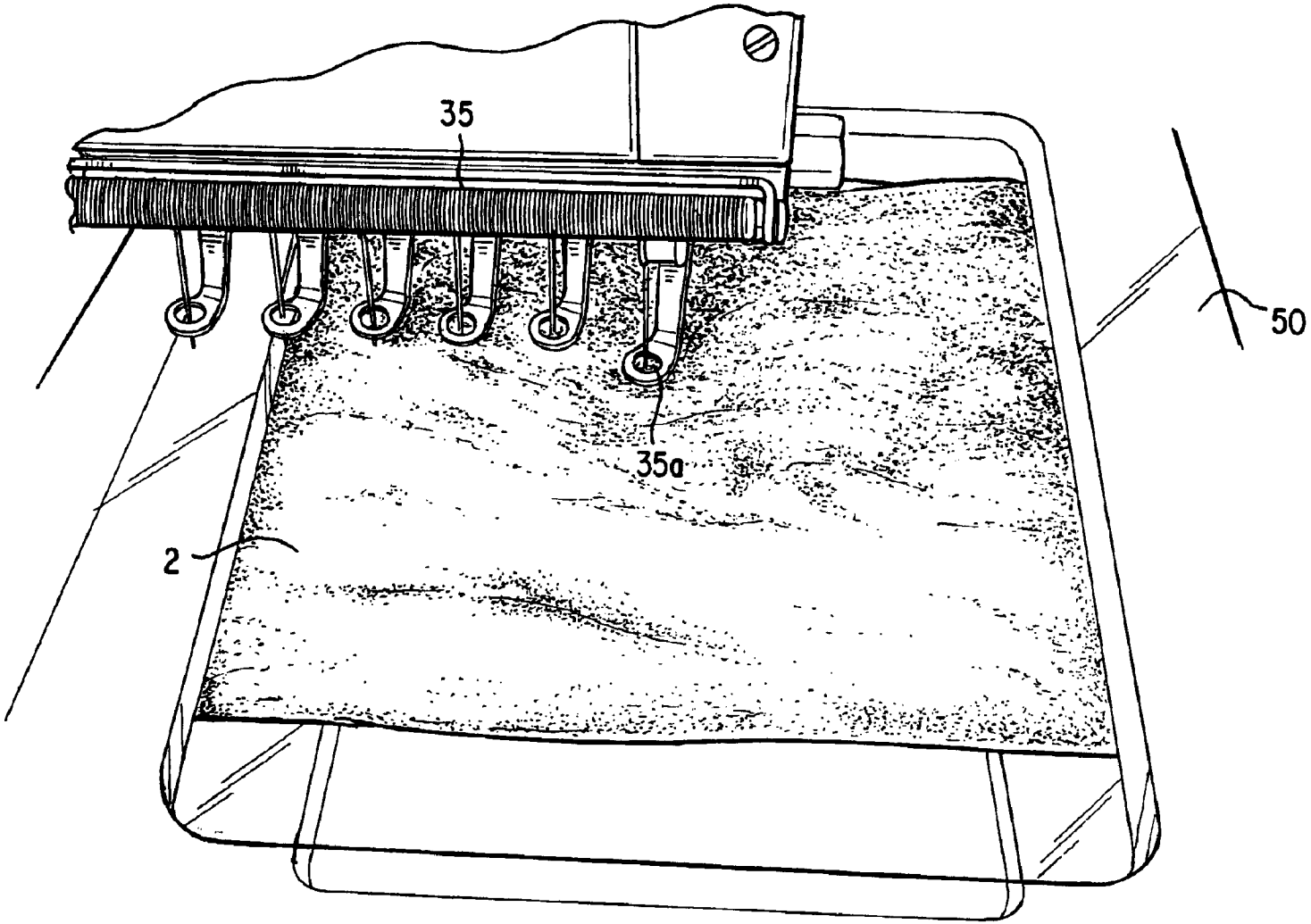
FIG. 4 illustrates a splice being applied by the embroidery machine of FIG. 2 in a preprogrammed stitching pattern.

FIG. 3 illustrates the machine 100 having overlapping ends of a fiber tow 2 secured in a clamp 50 that in turn is secured to the substrate supporting surface 25. The sewing head 35 is positioned over the overlapping ends of the tow 2 in preparation for sewing. FIG. 4 shows the sewing head 35 in operation, in which a bobbin 35*a* sews thread through the overlapping ends of the tow 2 to form the splice.

Figure 5:
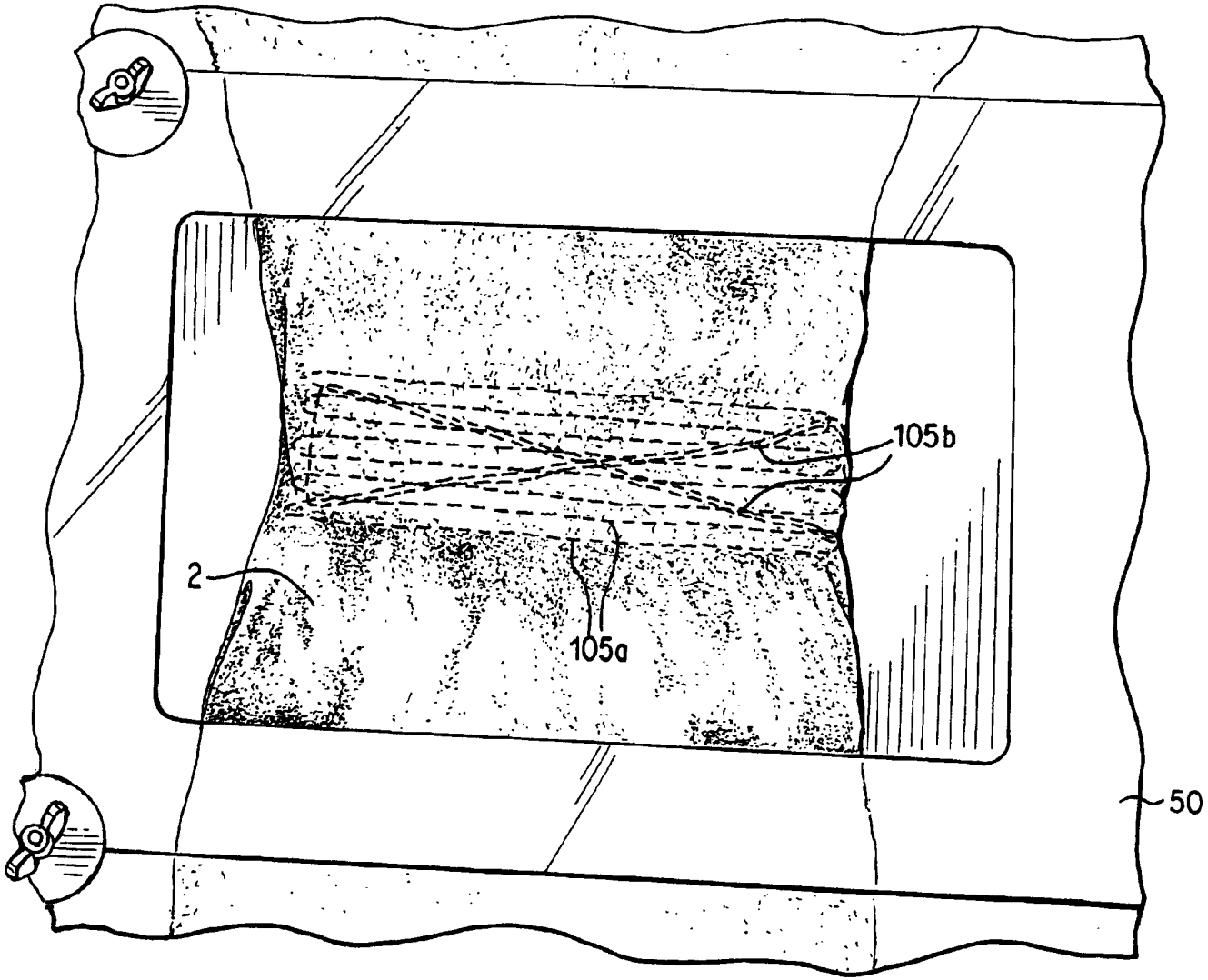
FIG. 5 is a top view of spliced tow ends, with the tow ends still secured in by a clamp, in accordance with a preferred embodiment of the invention.
Figure 10:
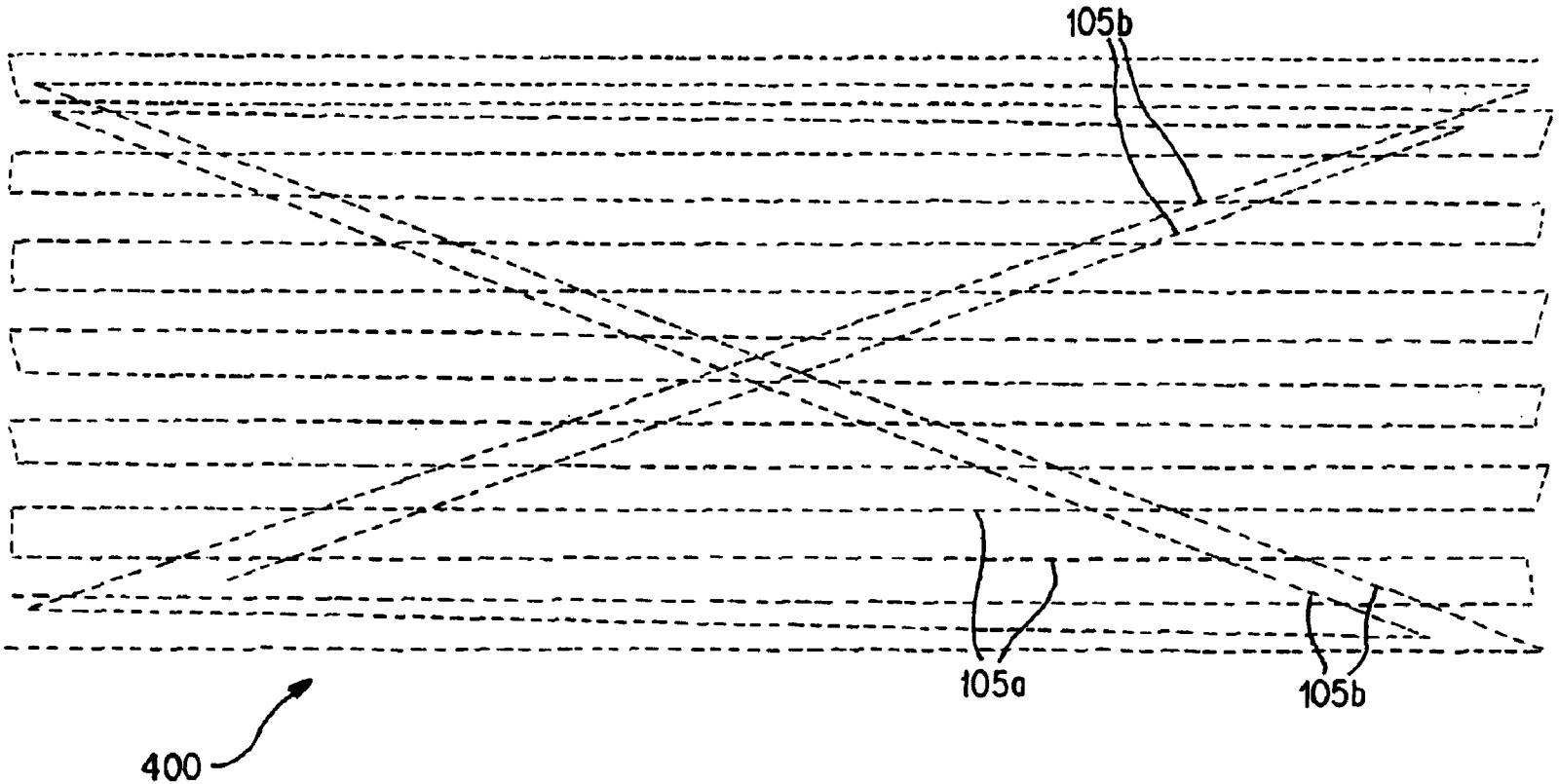
FIG. 10 is a schematic illustration of a preprogrammed stitching pattern for the splice in accordance with a preferred embodiment of the invention.

A stitching pattern can be selected or designed to provide adequate strength characteristics as may be needed for a particular application. FIG. 5 shows a splice formed on overlapping ends of tow 2, with the tow still secured in the clamp 50. The preprogrammed pattern 400 used for this splice, shown schematically in FIG. 10, includes a plurality of closely-spaced parallel lines 105*a* traversing the width direction of the tow 2, and diagonal lines 105*b* forming an "X" across the parallel lines 105*a*. When splicing nylon-6,6 fiber tow ends using this pattern, it was found that the splice was sufficiently strong to consistently survive the ensuing stretching and heat setting operations.

The stitching pattern 400 should provide the strength characteristics needed for the splice in a relatively small area. Preferably, the depth d of the overall pattern 400 is less than about 3 inches, more preferably less than about 2 inches. The spacing between the lines parallel lines 105*a* typically is about 1/16". Preferably each of the parallel lines 105*a* and diagonal lines 105*b* can be double stitched, triple stitched, etc., to increase the strength of the splice.

Figure 1B:
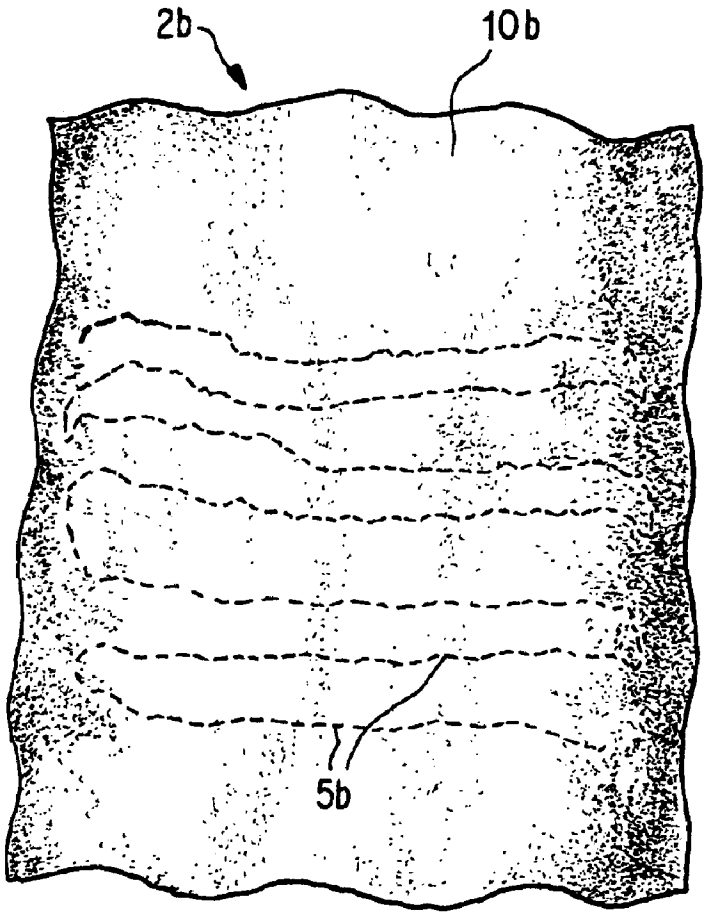
FIGS. 1A and 1B show a side-by-side comparison of a tow splice prepared in accordance with a preferred embodiment of the present invention (FIG. 1A), and a tow splice prepared using conventional lacing techniques (FIG. 1B)
Figure 1A:
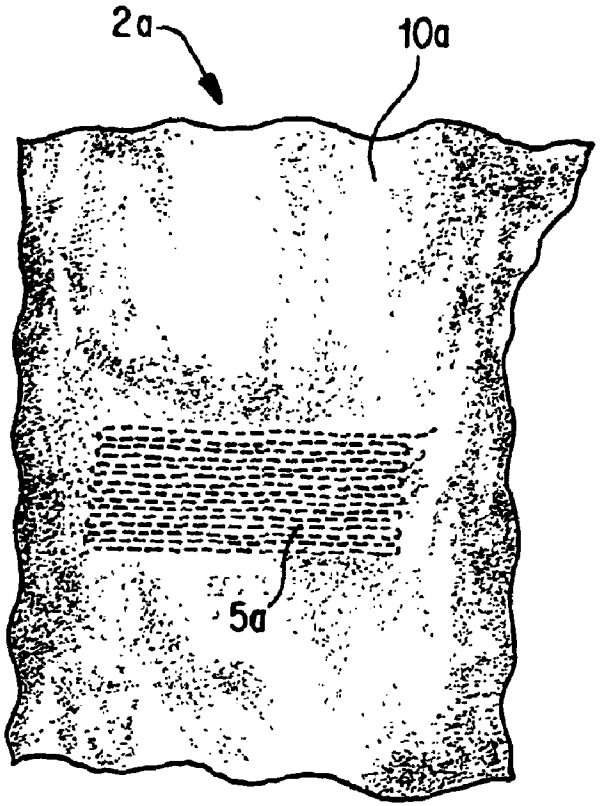

FIGS. 1A and 1B show a side-by-side comparison of a splice made in accordance with the invention (FIG. 1A) and a splice made in accordance with conventional lacing techniques (FIG. 1B). FIGS. 1A and 1B illustrate overlapping end portions of nylon-6,6 tow 2*a* and 2*b*, respectively, each wrapped with plastic matrix films 10*a* and 10*b*, respectively. As can be seen, the stitching pattern 5*a* used in the splice of FIG. 1A is considerably more compact than the manually sewn thread 5*b* used in lacing, resulting in a narrower splice. The splice of the invention does not require as much overlap as is required for lacing. It is desirable to shorten the area of overlap to reduce the amount of waste and/or inferior quality fiber produced.

Figure 6:
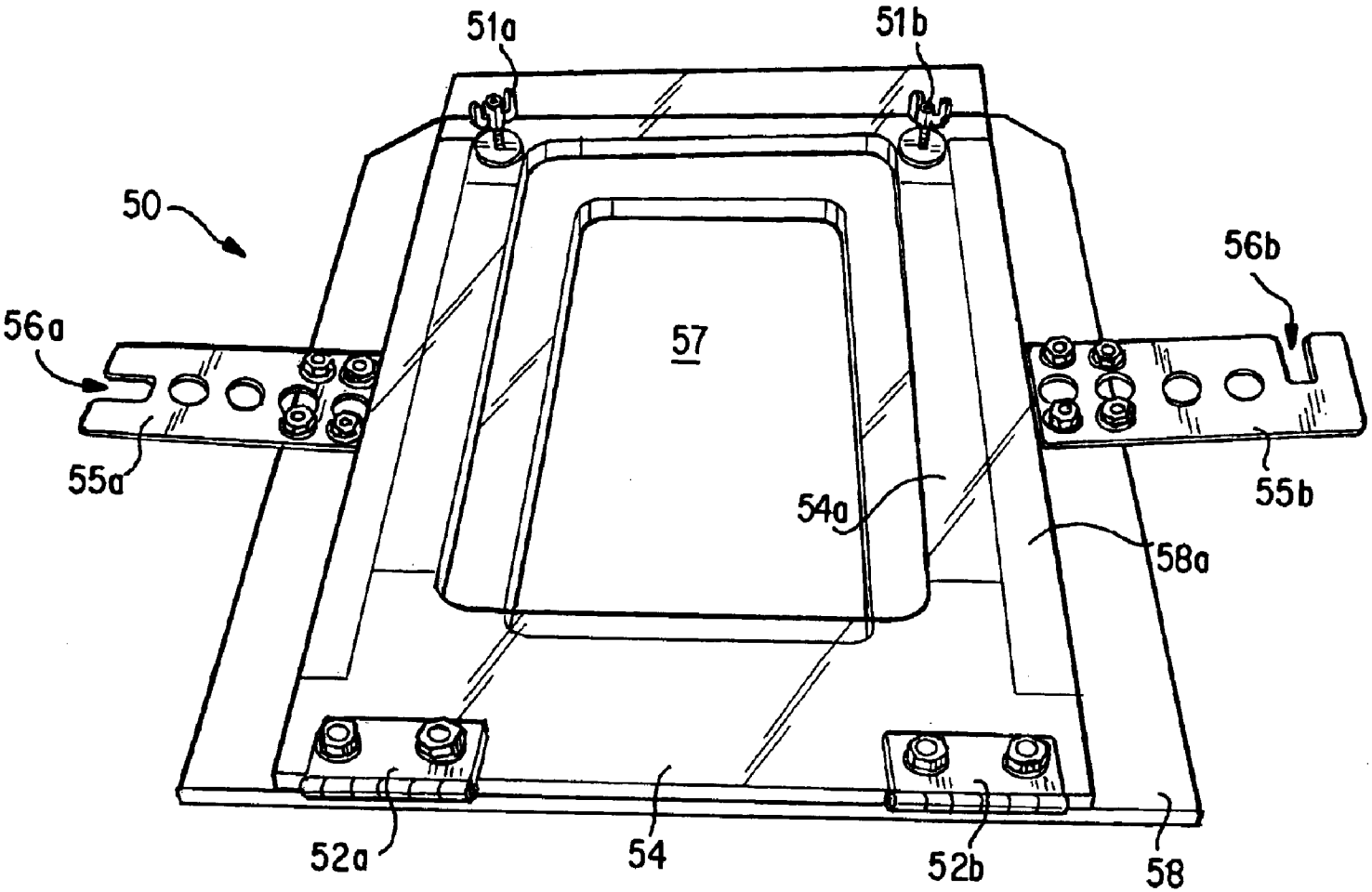
FIG. 6 is a perspective view of a clamp for securing first and second tow ends in accordance with a preferred embodiment of the invention.
Figure 7:
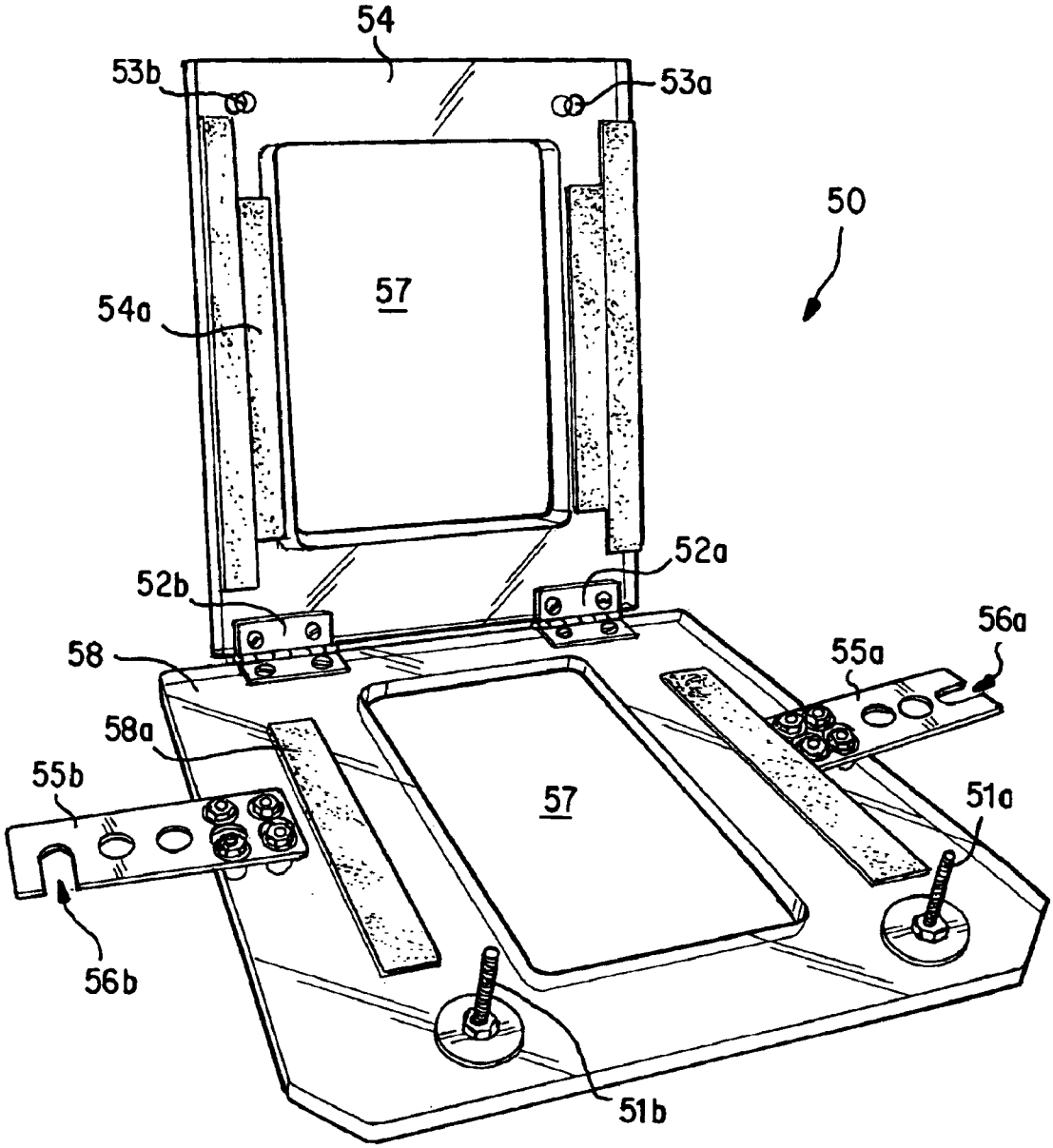
FIG. 7 is a perspective view of the clamp of FIG. 6 in the open position.
Figure 8A:
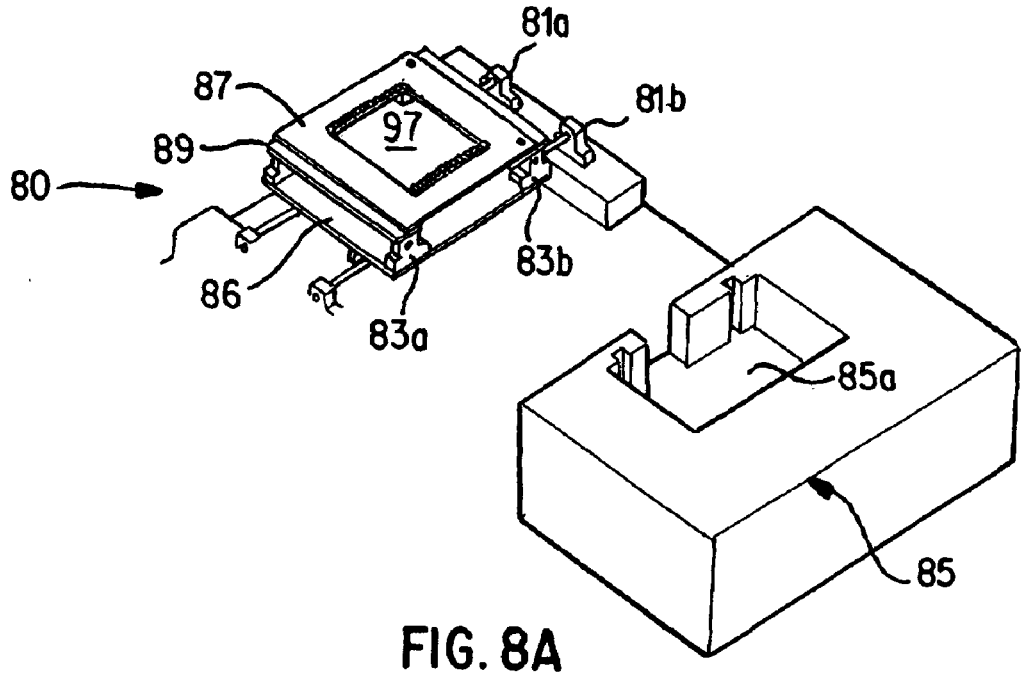
FIGS. 8A–8D illustrate an x-y plate and tow holding assembly in accordance with an alternative embodiment of the invention.
Figure 8B:
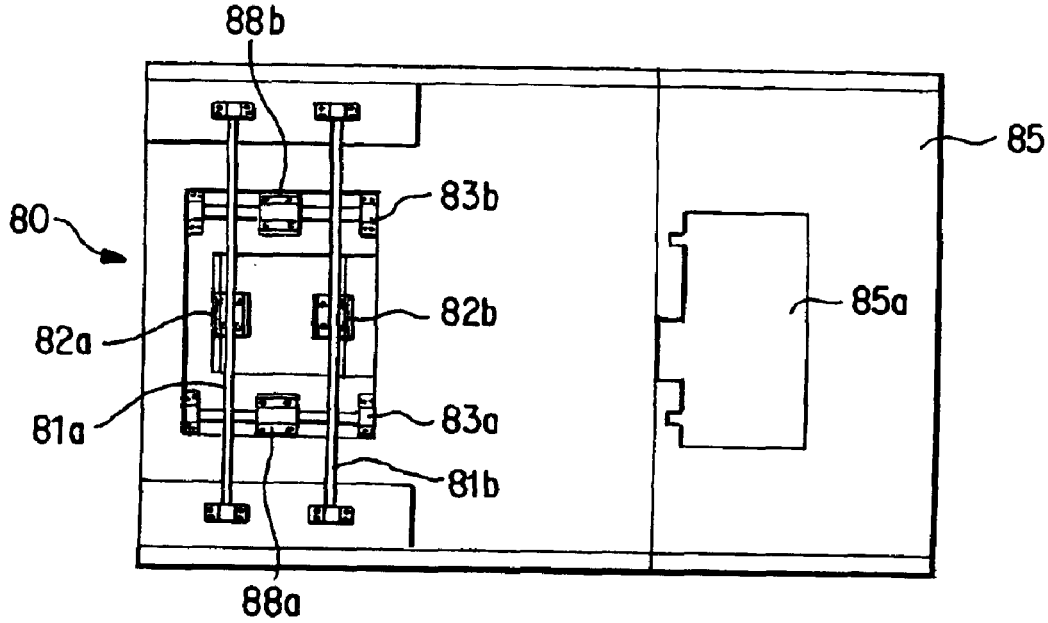
Figure 8C:
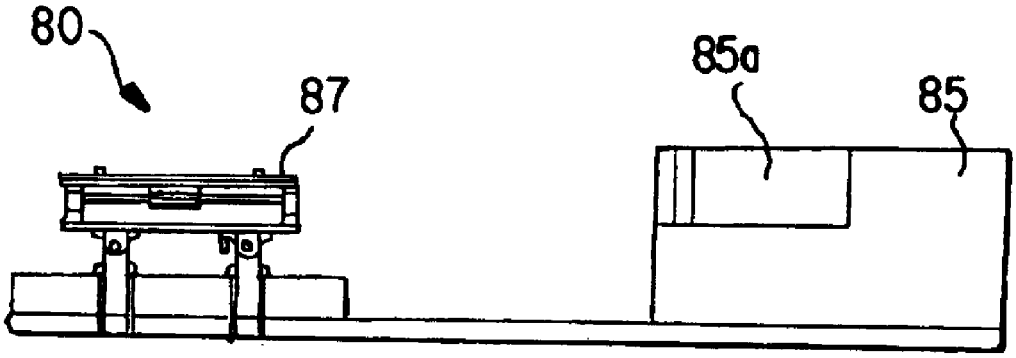
Figure 8D:
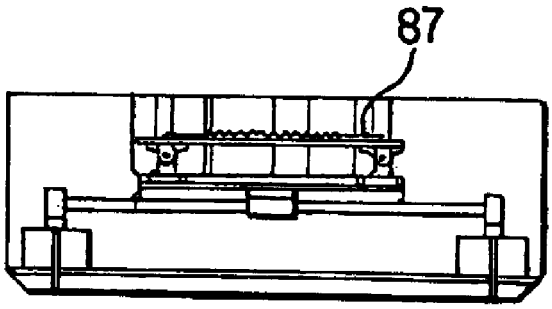
Figure 9A:
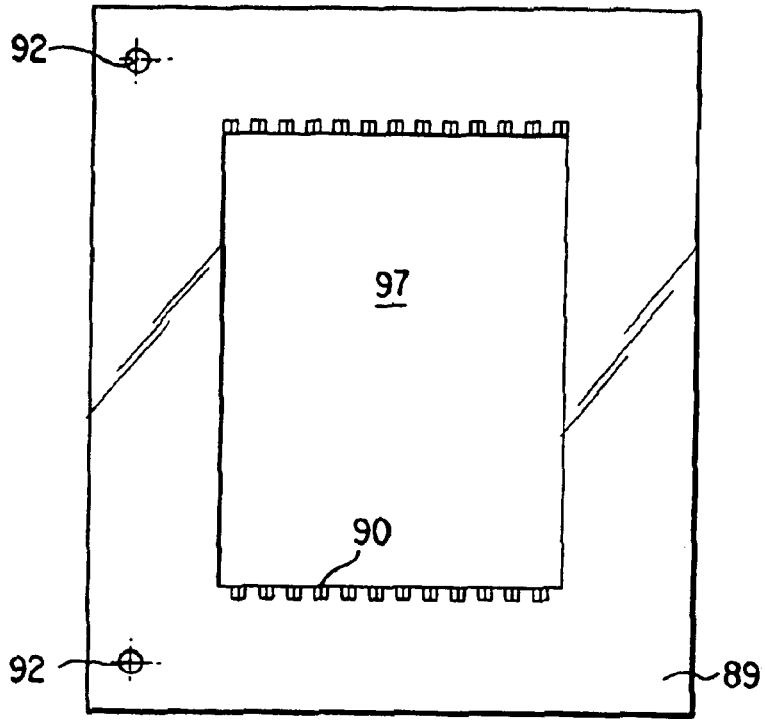
FIGS. 9A–9D illustrate the detail of the bottom plate for the assembly shown in FIGS. 8A–8D.
Figure 9B:
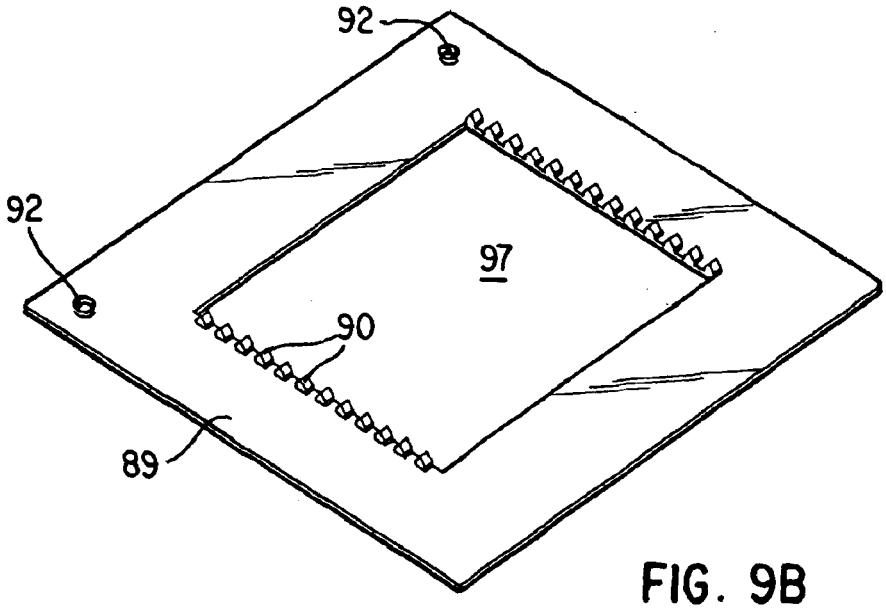
Figure 9C:
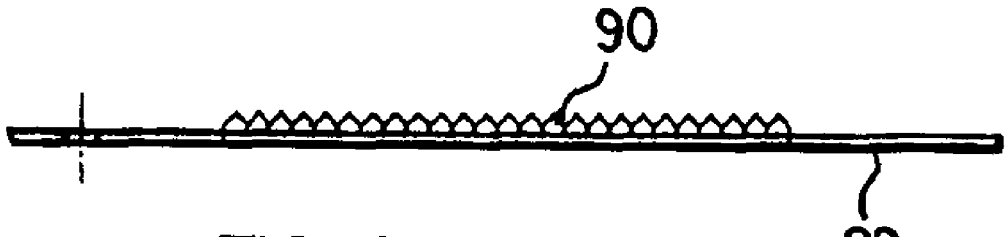
Figure 9D:
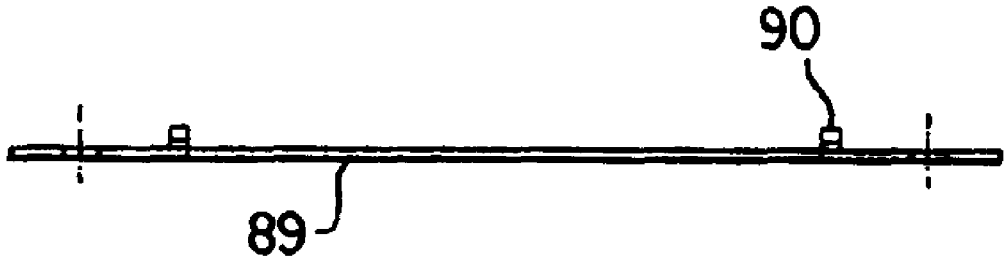

The details of a clamp 50 in accordance with a preferred embodiment of the invention are illustrated in FIGS. 6 and 7. The clamp includes a bottom plate 58 and a top plate 54 which are joined at one end by hinges 52*a* and 52*b*. Two screws 51*a* and 51*b* extend from the bottom plate 58 through apertures 53*a* and 53*b* in the top plate 54. Wing nuts (not shown) or the like are tightened onto the screws 51*a* and 51*b* to force the upper plate 54 into contact with the overlapping tow ends placed on the lower plate 58, to secure the overlapping tow ends in the clamp 50 in preparation for splicing. Each of the lower plate 58 and the upper plate 54 preferably contains strips 58*a* and 54*a*, respectively, which have a high coefficient of friction for engaging the tow ends. The lower plate 58 has brackets 55*a* and 55*b* in which holes or grooves 56*a* and 56*b*, respectively, are formed. Bolts (not illustrated) are fed through the holes or grooves 56*a* and 56*b*, and are tightened into the threaded apertures 27*a* and 27*b* (see FIG. 2) to secure the clamp 50 to the substrate supporting surface 25 of the embroidery machine 100. The clamp has an open center portion 57 to enable the sewing head 35 to form the stitching pattern in the portion of the overlapping area that is exposed in the open portion 57.

FIG. 7 illustrates the clamp 50 in the open position. The upper plate 54 is rotated away from the lower plate 58 via hinges 52*a* and 52*b*. The open position permits insertion of the overlapping fiber tow ends into the clamp, as well as removal of the spliced tow ends from the clamp 50 following splicing, as discussed more fully below.

As an alternative to an open-face clamp 50 as shown, the overlapping tow ends can be held by any device capable of holding the tow ends without slippage during splicing. By way of example, the tow ends alternatively can be engaged by a cylinder that forces the tow ends against a stationary surface and holds them in place during splicing.

FIGS. 8A–8D illustrate an x-y table 80 having a plate assembly for supporting and displacing the overlapping tow ends as they are spliced by a stationary sewing machine (not shown) in accordance with an alternative embodiment of the invention. The sewing machine is mounted on a support 85 having recessed portions 85*a* into which feet of the sewing machine are placed. The x-y table 80 includes linear bearings 81*a*, 81*b*, 83*a*, and 83*b*, and linear gears 82*a*, 82*b*, 88*a*, and 88*b* that together permit displacement of a plate assembly along the x and y coordinate axes. The plate assembly includes a lower plate 89 and an upper plate 87 for holding the overlapping tow ends. A moving plate 86 displaces the upper/lower plate combination 87/89 along the linear bearings 81*a* and 81*b*. The support 85 is positioned such that the bobbin of the sewing machine is positioned over cut-out portions 97 of the holding plates 89 and 87.

The overlapping tow ends are placed onto the lower plate 89. As shown in FIGS. 9A–9D, the lower plate 89 has raised teeth 90 along two edges that are adjacent to a cut-out portion 97 through which the sewing bobbin sews the overlapping tows. The teeth 90 prevent the tow from slipping while it is engaged in the tow holding assembly. The upper plate 87 is placed over the overlapping tow ends, and pegs in the upper plate (not shown) slip into holes 92 in the lower plate to ensure proper alignment. A step motor (not shown) is used to control positioning of the moving plate 86 and the upper/lower plate combination 87/89 along their respective axes. A programmable logic controller is used to synchronize movement of the moving plate 86, the upper/lower plate combination 87/89, as well as operation of the sewing machine to apply a preprogrammed stitching pattern to the overlapping tows.

During a typical splicing operation when using the embroidery machine and clamp assembly shown in FIGS. 2–7, an optional matrix material is placed onto the lower plate 58 of the clamp 50 while in the open position (FIG. 7). An example of a suitable matrix material is Dissolve-Away® Stabilizer, a water-soluble polymeric film available from Sundrop Textiles Inc. of British Columbia, Canada. Another example of a suitable matrix material is a non-woven fabric. The matrix material is optional and the desirability of its use depends on such considerations as the type of tow material used. It has been found that nylon-6,6 tows, for example, can be spliced with acceptable uniformity without using a matrix material. An appropriate matrix material, when used, can be suitably selected by persons skilled in the art in accordance with the needs of a particular application and with the aid of no more than routine experimentation.

After a section of matrix material is placed onto the lower plate 58, the overlapping tow ends are placed over the matrix material, and the matrix material is wrapped around the overlapping portion. The upper plate 54 is closed over the tow material, and wing nuts are tightened onto the screws 51*a* and 51*b* to secure the tow material in the clamp 50. The clamp 50 then is secured onto the substrate supporting surface 25 of the embroidery machine 100 by tightening screws through the holes 56*a* and 56*b* in the mounting brackets 55*a* and 55*b* on the clamp 50 and into the threaded apertures 27*a* and 27*b* on the supporting surface 25. The controller 40 is then activated to apply the preprogrammed stitching pattern to the overlapping portion of the tows.

Once the stitching pattern has been applied to the overlapping portion of the tows, the clamp is removed from the supporting surface 25 and opened to remove the newly spliced tow ends. Excess matrix material and any loose fiber material can be cut away and discarded. The stretching and heat setting, or other subsequent processing can then be resumed.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention and described and claimed herein.

What is claimed is:

1. A method of joining indeterminate length fiber tows end-to-end comprising:

providing a first fiber tow and a second fiber tow;

placing an end portion of the first tow over an end portion the second tow so that the first and second tow ends overlap each other in an overlapping area;

securing the first and second tows while leaving at least a portion of the overlapping area exposed;

positioning the overlapping area of the tows on a sewing unit having a support surface, a sewing head, and a controller for executing a preprogrammed stitching pattern, wherein at least one of the support surface and the sewing head is displaceable along first and second axes to execute the preprogrammed stitching pattern; and actuating the controller to displace at least one of the support surface and the sewing head along the first and second axes to form the preprogrammed stitching pattern in the exposed portion of the overlapping area;

wherein each of the first tow and the second tow has a width dimension, and wherein the predetermined stitching pattern comprises a plurality of generally parallel lines in the width dimension of the tows and at least one diagonal line traversing at least some of the generally parallel lines.

2. The method of claim 1 wherein the first fiber tow and the second fiber tow comprise synthetic fibers selected from the group consisting of polyester, nylon-6, nylon-6,6, polypropylene, acrylic, and blends thereof.

3. The method of claim 1 wherein the support surface is fixed and the sewing head is controllably displaceable along the first and second axes.

4. The method of claim 3 wherein the first and second fiber tow ends are secured using a clamp assembly, and wherein the clamp assembly in turn is secured to the support surface.

5. The method of claim 1 wherein the predetermined stitching pattern has an overall depth which is less than about 3 inches.

6. The method of claim 5 wherein the plurality of generally parallel lines are spaced by about 1/16".

7. A method of joining indeterminate length fiber tows end-to-end comprising:

providing a first fiber tow and a second fiber tow;

placing an end portion of the first tow over an end portion the second tow so that the first and second tow ends overlap each other in an overlapping area;

securing the first and second tows while leaving at least a portion of the overlapping area exposed;

positioning the overlapping area of the tows on a sewing unit having a support surface, a sewing head, and a controller for executing a preprogrammed stitching pattern, wherein at least one of the support surface and the sewing head is displaceable along first and second axes to execute the preprogrammed stitching pattern; and actuating the controller to displace at least one of the support surface and the sewing head along the first and second axes to form the preprogrammed stitching pattern in the exposed portion of the overlapping area;

wherein a matrix material comprising a water-soluble polymeric film or a non-woven fabric is placed over a portion of the overlapping area prior to securing the first and second tows.

8. A method of joining indeterminate length fiber tows end-to-end comprising:

providing a first fiber tow and a second fiber tow;

placing an end portion of the first tow over an end portion the second tow so that the first and second tow ends overlap each other in an overlapping area;

securing the first and second tows while leaving at least a portion of the overlapping area exposed;

positioning the overlapping area of the tows on a sewing unit having a support surface, a sewing head, and a controller for executing a preprogrammed stitching pattern, wherein the sewing head is fixed and the support surface comprises a plate assembly controllably displaceable along first and second axes to execute the preprogrammed stitching pattern; and actuating the controller to displace the support surface along the first and second axes to form the preprogrammed stitching pattern in the exposed portion of the overlapping area.

9. An apparatus for joining indeterminate length fiber tow ends, the apparatus comprising:

a support surface adapted for holding overlapping end portions of first and second fiber tows;

a sewing unit having a sewing head;

wherein at least one of the support surface and the sewing head is displaceable along first and second axes;

means for displacing at least one of the support surface and the sewing head along the first and second axes; and a controller for actuating movement of at least one of the support surface and the sewing head, whereby the sewing unit applies a preprogrammed stitching pattern in the exposed portion of the overlapping area to join the first and second fiber tow ends;

wherein the fiber tow ends are secured in a generally rectangular clamp which is attached to the support surface and wherein the clamp comprises an outer portion which engages the first and second fiber tows and an open inner portion permitting access to the overlapping portion of the first and second fiber tows.

10. The apparatus of claim 9 wherein the support surface is fixed and the sewing head is controllably displaceable along the first and second axes.

11. An apparatus for joining indeterminate length fiber tow ends, the apparatus comprising:

a support surface adapted for holding overlapping end portions of first and second fiber tows;

a sewing unit having a sewing head, wherein the sewing head is fixed and the support surface comprises a plate assembly controllably displaceable along first and second axes;

means for displacing the support surface along the first and second axes; and a controller for actuating movement of the support surface, whereby the sewing unit applies a preprogrammed stitching pattern in the exposed portion of the overlapping area to join the first and second fiber tow ends.

12. A fiber tow splice joining a first fiber tow and a second fiber tow, wherein each of the first tow and the second tow has a width dimension, and wherein an end portion of the first tow overlaps an end portion of the second tow to form an overlapping area; and a thread sewn through the overlapping area in a predetermined stitching pattern, wherein the predetermined stitching pattern comprises a plurality of generally parallel lines in the width dimension of the tows and at least one diagonal line traversing at least some of the generally parallel lines.

13. The fiber tow splice of claim 12 wherein the predetermined stitching pattern has an overall depth which is less than about 3 inches.

14. The fiber tow splice of claim 13 wherein the plurality of generally parallel lines are spaced by about 1/16".

15. The fiber tow splice of claim 12 wherein each of the generally parallel lines and diagonal lines is double stitched or triple stitched to increase strength of the splice.

16. The fiber tow splice of claim 12 further comprising a matrix material covering at least a portion of the overlapping area, the matrix material comprising a water-soluble polymeric film or a non-woven fabric.

17. The fiber tow splice of claim 12 wherein the first fiber tow and the second fiber tow comprise synthetic fibers selected from the group consisting of polyester, nylon-6, nylon-6,6, polypropylene, acrylic, and blends thereof.

* * * * *